United States Patent [19]

LaBate et al.

[11] Patent Number: 4,640,498

[45] Date of Patent: Feb. 3, 1987

[54] HORIZONTALLY AND VERTICALLY MOVABLE ELEVATED APPARATUS FOR PLACING SLAG RETAINING MEANS IN TAPPING CONVERTERS

[75] Inventors: Micheal D. LaBate, Ellwood City; Joseph Perri, Coraopolis, both of Pa.

[73] Assignee: Insul Company, Inc., East Palestine, Ohio

[21] Appl. No.: 733,911

[22] Filed: May 14, 1985

[51] Int. Cl.[4] ..... C21C 5/46

[52] U.S. Cl. ..... 266/272; 222/598; 222/602

[58] Field of Search ..... 266/45, 230, 272; 222/598, 602

[56] References Cited

U.S. PATENT DOCUMENTS

| | | | |
|---|---|---|---|
| 3,459,209 | 8/1969 | Kobusch et al. | 222/602 |
| 4,431,169 | 2/1984 | Fuzii et al. | 266/236 |
| 4,468,013 | 8/1984 | LaBate | 266/272 |
| 4,494,734 | 1/1985 | LaBate et al. | 266/45 |
| 4,553,743 | 11/1985 | LaBate, II et al. | 222/597 |

FOREIGN PATENT DOCUMENTS

| | | | |
|---|---|---|---|
| 32604 | 8/1977 | Japan | 266/236 |

*Primary Examiner*—L. Dewayne Rutledge
*Assistant Examiner*—Robert L. McDowell
*Attorney, Agent, or Firm*—Harpman & Harpman

[57] ABSTRACT

Slag retention devices for use in a tapping converter, such as used in the steel industry, are positioned by an improved apparatus positioned substantially above the charging floor in front of the tapping converter and movable horizontally with respect to an overhead support and vertically with respect to the charging floor and the converter. A tiltable drive mechanism telescopically supports an elongated boom, the outer end portion of which is arranged to releasably carry a slag retaining device and move into the tapping converter and position the slag retaining device in the tap hole thereof.

8 Claims, 4 Drawing Figures

HORIZONTALLY AND VERTICALLY MOVABLE ELEVATED APPARATUS FOR PLACING SLAG RETAINING MEANS IN TAPPING CONVERTERS

BACKGROUND OF THE INVENTION

1. Technical Field

This invention relates to devices for accurately and forcefully positioning slag retaining closures or darts in a tapping converter during the tapping of steel therefrom.

2. Description of the Prior Art

Prior structures of this type are best represented by the disclosures of U.S. Pats. Nos. 3,459,209, 4,431,169, and 4,468,013. The slag retaining devices positionable by the prior art devices and the present invention are best illustrated in U.S. Pat. No. 4,449,734.

SUMMARY OF THE INVENTION

The present invention utilizes a drive tube telescopically mounting an elongated boom which in turn detachably carries the slag retaining device into a tapping converter and positions the same in the tap hole thereof. The driver tube is pivotally supported on a vertically movable structure which in turn is carried by a horizontally movable carriage positioned substantially above the charging floor which is adjacent the tapping converter so as to be movable upwardly and away from the charging floor and the tapping converter.

DESCRIPTION OF THE PREFERRED EMBODIMENT

Figure 1:
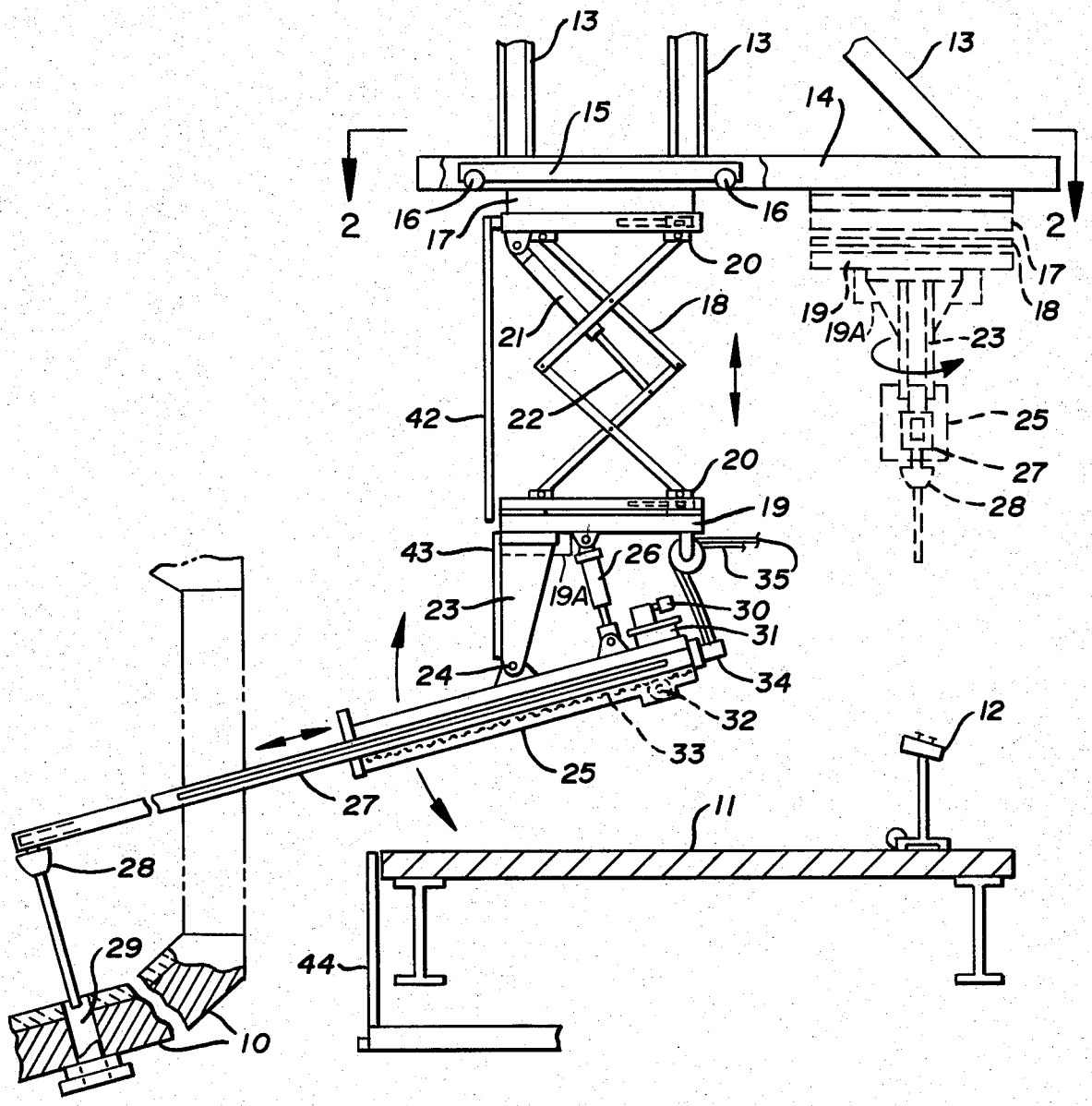
FIG. 1 is a side elevation of a portion of a tapping converter, a charging floor adjacent thereto and a device positioned substantially thereabove for positioning a slag retaining device in the tap hole of the tapping converter. Broken lines in FIG. 1 show the device in vertically retracted position.

By referring to the drawings and FIG. 1 in particular a portion of a tapping converter 10 will be seen positioned with its charging throat directed towards a charging floor 11 in a typical steel making facility. The charging floor in a typical installation is approximately seventeen feet from front to back and is elevated so that it is approximately two and a half feet below the horizontal axis of the converter 10. A portable free-standing operator's station 12 is usually positioned adjacent the back side of the charging floor 11. An enclosure incorporating a roof-like structure is positioned substantially above the charging floor 11 and downwardly extending support members 13 are carried thereby. A pair of horizontally spaced horizontally exetnding channel-like rails 14 are carried on the support members 13 and a carriage 15 is positioned in movable relation to the rails 14 by a plurality of wheels 16 engaging the same. A frame 17 of the carriage 15 extends therebelow and a double scissors lift device 18 is attached to the frame 17 in depending relation and to a first portion of a rotatable table 19 positioned therebelow. Means 19a is used to rotate the rotatable table 19. The double scissors lift device 18 is movably attached at its upper and lower ends to the frame 17 and the first part of the table 19 through slide members 20 slidably engaged on the frame member 17 and the rotatable table 19 as will be understood by those skilled in the art.

Piston and cylinder assemblies 21 are pivotably attached to the frame 17 with the piston rod 22 thereof pivotally attached to one of the double scissors 18 so that the double scissors lift device can be moved to an extended position where the rotatable table 19 is below the frame 17 and alternately to an upward location as shown in broken lines in FIG. 1 of the drawings. The table 19 has downwardly extending spaced arms 23 pivotally attached by a pivot 24 to a drive tube 25 and a secondary piston and cylinder assembly 26 is pivotally positioned between the rotatable table 19 and the drive tube 25 in spaced relation to the pivot 24.

An elongated insertion beam 27 is telescopically positioned partly within the drive tube 25 and extends outwardly therefrom a distance sufficient to position a closure or dart 28 in a tap hole 29 in the converter 10.

Still referring to FIG. 1 of the drawings, it will be seen that the carriage 15, its frame 17 and the double scissors lift device 18 by which the rotatable table 19, the tiltable drive tube 25 and the insertion beam 27 are supported, is also movable from the position shown in solid lines to the position shown in broken lines by reason of the extensions of the channel shaped rails 14. In the broken line showing in FIG. 1 of the drawings, the piston and cylinder assemblies 21 have been retracted so as to move the double scissors lift device 18 vertically and thus substantially elevate the drive tube 25 and the insertion beam 27 telescopically mounted therein. In such substantially elevated position, the drive tube 25, the insertion beam 27, and the closure or dart 28, which is releasably positioned in jaws formed in the end of the insertion beam 27 are positioned substantially above the charging floor 11 and in horizontally spaced relation to the tapping converter 10 so as to provide unusual working space and freedom of movement of the operators of the tapping converter in that the clear space above the charging floor extends substantially upward to the support members 13. The substantial offset elevation of the drive tube 25 and the insertion beam 27, etc. with respect to the throat of the tapping converter substantially eliminates the damage that otherwise occurs from the subjection of the drive tube 25 and its mechanism to the intense heat of the tapping converter.

The prior art devices such as disclosed in U.S. Pats. Nos. 4,468,013 and 4,478,392 are incapable of positioning the operating mechanism of the device for placing slag retention devices in the tapping converters in a substantially elevated and retracted position with respect to the tapping converter.

The devices for placing slag retention devices in tapping converters disclosed in copending application Ser. No. 06/643,499 now U.S. Pat. No. 4,553,743 in the two embodiments disclosed therein is capable of elevating and moving the devices for placing slag retention means in tapping converters with respect to the actual converter, but not to the extent possible in the present invention. In steel making facilities the mill operators and the responsible unions are becoming increasingly critical of the operation of the devices for placing slag retention devices in tapping converters and are insisting that the entire device be movable upward and away from the tapping converter and the charging floor forwardly thereof. The present invention is directly responsible to that situation and solves the problem presented thereby.

Still referring to FIG. 1 of the drawings, it will be seen that the drive tube 25 is provided with a hydraulically powered motor 30 which drives a gear reduction unit 31 and a pinion 32 which is engaged on a rack 33 on a portion of the insertion beam 27. Operation of the hydraulic powered motor 30 will thus move the insertion beam 27 telescopically with respect to the drive tube 25 as necessary in placing slag retention device in a tapping converter.

The slag retention device 28 is released from the jaws incorporated in the insertion boom 27 by the actuation of an air cylinder 34 carried on one end of the drive tube 25. Hoses supplying hydraulic fluid and compressed air for actuating the foregoing devices extend from the motor 30 and cylinder 34 over a roller 35 positioned below the table 19 and from that location to a source of the hydraulic fluid compressed air, etc. as will be understood by those skilled in the art.

Figure 2:
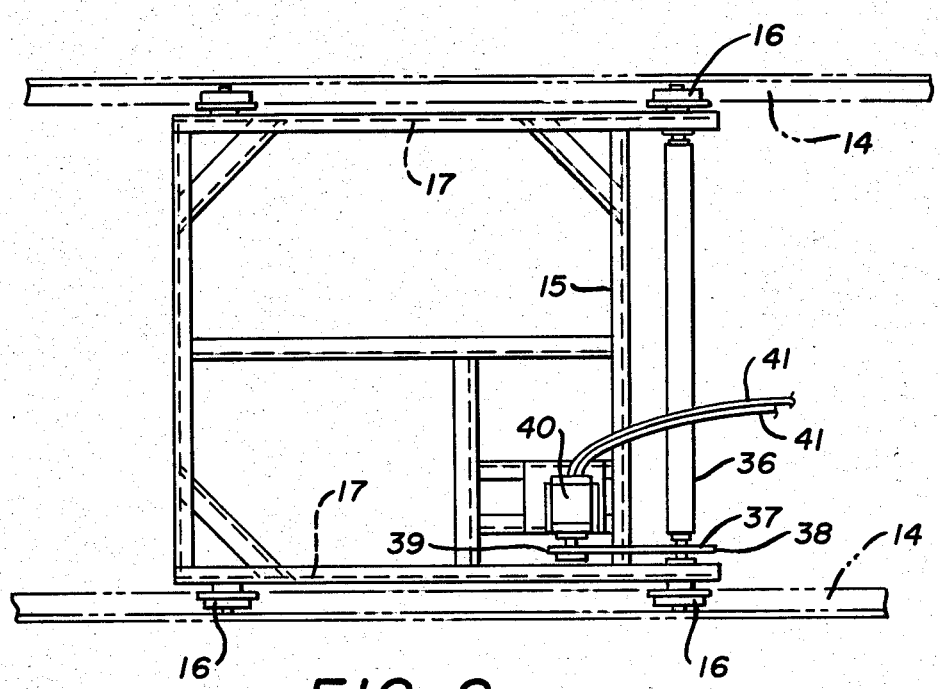
FIG. 2 is a top plan view on an enlarged scale taken on line 2—2 of FIG. 1.

By referring now to FIG. 2 of the drawings, it will be seen that the horizontally spaced horizontally extending rails 14 support the carriage 15 by way of the wheels 16 thereon and that a pair of the wheels 16 are connected by a transversely positioned axle-roller 36, one end of which is provided with a sprocket 37 and a drive chain 38 which in turn is trained over a secondary sprocket 39 on a fluid powered motor 40 carried on a portion of the carriage 15. Hoses 41 extend from the motor 40 to a source of hydraulic fluid under suitable operating pressure.

Figure 3:
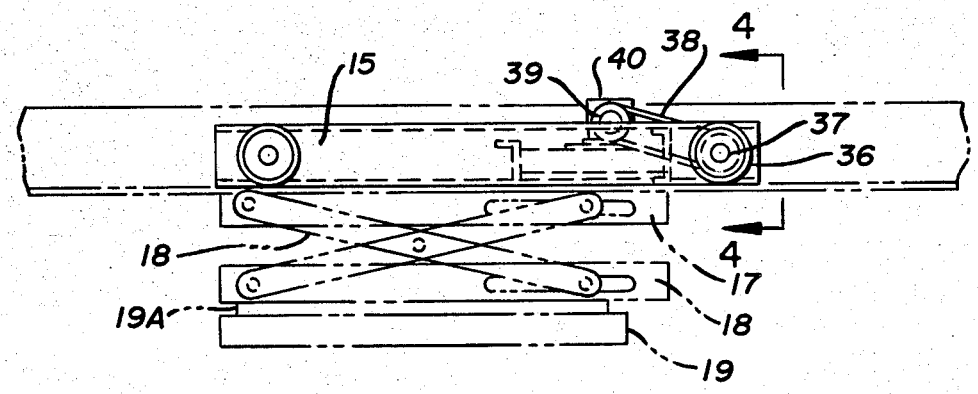
FIG. 3 is an enlarged side elevation of a portion of the device of FIG. 1 showing the same in upwardly retracted position.

By referring now to FIG. 3 of the drawings, it will be seen that the rotatable table 19 incorporates a first portion 19A attached to the lowermost portion of the double scissors lifting device 18 arranged to rotatably support the lower portion of the rotatable table 19 which as heretofore illustrated in FIG. 1 of the drawings directly carries the spaced arms 23 and the piston and cylinder assembly 26 which in turn support and tiltably position the drive tube 25 and the insertion beam 27 relative thereto so that the insertion beam 27 can be maneuvered both vertically, horizontally, tilted to various desired degrees as necessary for movement into the tapping converter to successfully position the closure or dart 28 in the tap hole 29.

It will be seen, by again referring to FIG. 1 of the drawings, that in addition to the movement of the insertion beam 27 imparted by the drive tube 25 mechanism, the insertion beam 27 and the drive tube 25 may be moved toward and away from the tapping converter 10 by the movement of the carriage 15 along the horizontally positioned rails 14 as hereinbefore described.

In FIG. 1 of the drawings, heat shields 42 and 43 are positioned between the operative parts of the device for placing slag retention devices in the tapping converter, the heat shield 42 being retractable along with the rotatable table 19 and the drive tube 25, etc. An additional heat shield 44 is positioned between the tapping converter and the charging floor and the structural supports therefor.

Figure 4:
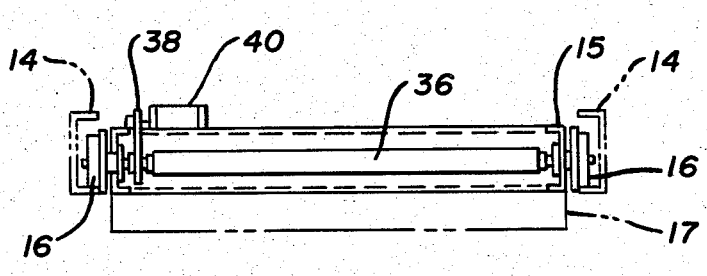
FIG. 4 is an end elevation on line 4—4 of FIG. 3.

By referring now to FIG. 4 of the drawings, an end elevation of the carriage 15, the axle-roller 36, and the frame 17 depending from the carriage 15 may be seen as taken on line 4—4 of FIG. 3. The channel-like configuration of the rails 14 will be observed to provide for the positive postioning of the carriage 15 by reason of the wheels 16 thereof being flanged where they engage the lower portions of the channel-like rails 14. The upper portions of the channel-like rails 14 are spaced somewhat above the flanged wheels 16 but sufficiently close thereto to prevent derailing of the carriage carriage 15 during the operation of the device for placing slag retention devices in tapping converters and particularly when the device and the carriage 15 thereof move longitudinally of the railway formed by the rails 14.

It will thus be seen that a substantially improved device for placing slag retaining devices in tapping converters has been disclosed and having thus disclosed our invention.

What we claim is:

1. Apparatus for placing a slag retaining device in a tap hole in a tapping converter adjacent a charging floor, said appparatus comprising a horizontally disposed railway suspended from overhead supports substantially above said charging floor, a drive tube and an elongated insertion beam movable carried thereby, a carriage on said overhead railway and a vertically movable device depending from said carriage, a rotatable table on said vertically movable device, said drive tube pivotally mounted to said rotatable table, first means for moving said carriage on said railway; second means for moving said vertically movable device and third means for moving said elongated insertion beam relative to said drive tube, jaws on one end of said elongated insertion beam for detachably holding said slag retaining device whereby said drive tube and said elongated insertion beam may be moved vertically and horiziontally and rotated with respect to said charging floor adjacent said tapping converter.

2. The apparatus for placing a slag retaining device in a tap hole in a tapping converter set forth in claim 1 and wherein said vertically movable device is a double scissors lift device.

3. The apparatus for placing a slag retaining device in a tap hole in a tapping converter set forth in claim 1 and wherein motion imparting means is positioned between said rotatable table and said drive tube for tilting said drive tube relative thereto.

4. The apparatus for placing a slag retaining device in a tap hole in a tapping converter set forth in claim 1 and wherein jaw actuating means is mounted on said drive tube and operatively connected with said jaws on one end of said elongated insertion beam for opening and closing the same with respect to said slag retaining device.

5. The apparatus for placing a slag retaining device in a tap hole in a tapping converter set forth in claim 1 and wherein an operator's stand is positioned on said charging floor and said first, second and third means are in communication therewith and controlled therefrom.

6. The apparatus for placing a slag retaining device in a tap hole in a tapping converter set forth in claim 1 and wherein said third means for moving said elongated insertion beam relative to said drive tube comprises a rack affixed to said elongated insertion beam and a pinion rotatably mounted in said drive tube and engaged with said rack and means for rotating said pinion.

7. The apparatus for placing a slag retaining device in a tap hole in a tapping converter set forth in claim 1 and wherein extensible and retractable means is positioned between said table and said drive tube in spaced relation to said pivotal mounting of said drive tube on said table for moving the ends of said drive tube and said elongated insertion beam in substantially vertical arcuate paths.

8. The apparatus for placing a slag retaining device in a tap hole in a tapping converter set forth in claim 1 and wherein said horizontally disposed railway suspended from overhead supports substantially above said charging floor extends toward and away from said tapping converter.

* * * * *